United States Patent [19]

Waugh

[11] 4,145,152

[45] Mar. 20, 1979

[54] TEMPORARY HIGHWAY REFLECTOR COVER

[76] Inventor: Bobby L. Waugh, 30742 Saddleback Rd., Valley Center, Calif. 92082

[21] Appl. No.: 909,358

[22] Filed: May 25, 1978

[51] Int. Cl.[2] ..... E01F 9/06

[52] U.S. Cl. ..... 404/71; 118/505; 404/16; 53/382

[58] Field of Search ..... 404/16, 9, 71; 118/504, 118/505; 51/274, 310; 53/133, 382

[56] References Cited

U.S. PATENT DOCUMENTS

| | | | |
|---|---|---|---|
| 2,728,323 | 12/1955 | Walton | 118/505 |
| 2,959,152 | 11/1960 | Byers | 118/505 |
| 3,315,638 | 4/1967 | Hajduk | 118/505 |
| 3,854,448 | 12/1974 | Kromanaker | 118/505 |

*Primary Examiner*—Nile C. Byers, Jr.
*Attorney, Agent, or Firm*—Ralph S. Branscomb

[57] ABSTRACT

The invention is a disposable, easily-removable masking cap for pavement-mounted highway reflectors to permit the taring or other re-surfacing of the roadway while protecting the reflectors so that they need not be graded off prior to resurfacing.

7 Claims, 5 Drawing Figures

TEMPORARY HIGHWAY REFLECTOR COVER

BACKGROUND OF THE INVENTION

Within the last few years, the highway stripes and low-profile white convex highway bumps that have been used in the past to define the different lanes on highways, back roads and freeways have been replaced with a type of reflector which is trapezoidal in transverse cross-section and which represents a great improvement in highway design inasmuch as regardless of glare, or covering of the roadway surface with rain water, the reflectors sharply identify the lanes of the roadway and prevent drivers from becoming disoriented and driving off the road or into other vehicles.

Especially on country roads, where these reflectors are utilized to define the center line, it is the custom of highway departments to use a blade to grade off the reflectors prior to resurfacing the road and then to replace them individually after the tarring, asphaulting, or other process is complete.

Due to the moderately high cost of these reflectors coupled with the enormous numbers of them that are used, it is in keeping with the modern tendency toward reduced operating budgets that the Highway Department and other cost-cutting forces that these reflectors not be graded off and destroyed but rather preserved, if possible to do so at a lower cost.

SUMMARY OF THE INVENTION

The present invention is a mask which temporarily is adhered to the reflector and which, by preventing the deposit of road surfacing material on the reflector itself, permits the reflector to be retained in position during the resurfacing operation, subsequent to which the mask is removed.

The mask comprises a cup portion which is concave and trapezoidal in one cross-section and rectangular in the other. The cut fits precisely over the upper exposed surfaces of the reflector element, and a pull-tab extending up from one edge of the cup contains a ring on the distal end which may be pulled upwardly by means of a hook operated by a worker riding or walking past the line of reflectors to rip the entire mask free of the reflector when the surfacing operation is over. The pull-tab may be adhered or otherwise releasably attached to the upper surface of the cup so as to produce a profile which does not interfere with the resurfacing operation and which does not otherwise become awkward prior to the removal of the mask.

DETAILED DESCRIPTION OF THE PREFERRED EMBODIMENT

Figure 1:
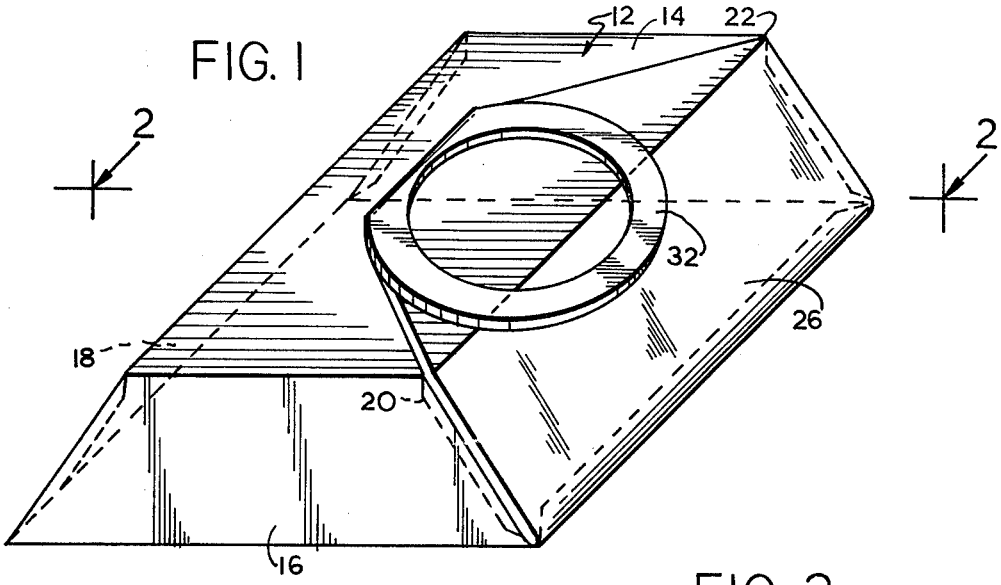
FIG. 1 is a prospective view of the mask as it appears in position covering a pavement-mounted highway reflector.
Figure 2:
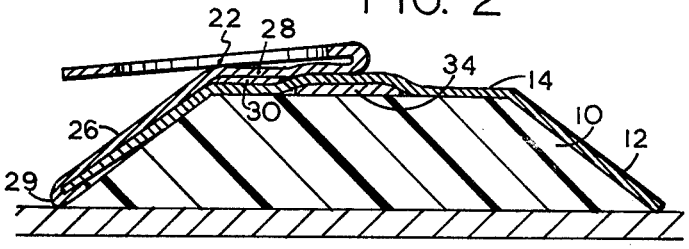
FIG. 2 is a cross-section taken along lines 2—2 of FIG. 1.

FIG. 1 is a representation of the mask in place over a highway pavement-mounted reflector of the type used in lane dividers, one such reflector being shown in cross-section in FIG. 2 at 10. This type of reflector is advantageous in that it catches and reflects the light from on-coming headlights and, unlike reflective paint striping, is not rendered inoperable, nor is it at all affected, by heavy rains. Because it extends above the pavement surface, the reflector is also the first thing to be cleared by passing vehicle tires during snow, and thus is a significant contribution to highway safety.

Periodically the road surface deteriorates to such a condition that it is necessary to either repave with a thin layer of asphault, or to apply a layer of tar in the case of country roads. It is the purpose of the mask of the invention to enable this re-surfacing to be done without grading off the lane divider reflectors. To this end, the mask is provided similar in size and shape to the reflector to fit rather flushly thereover.

Figure 3:
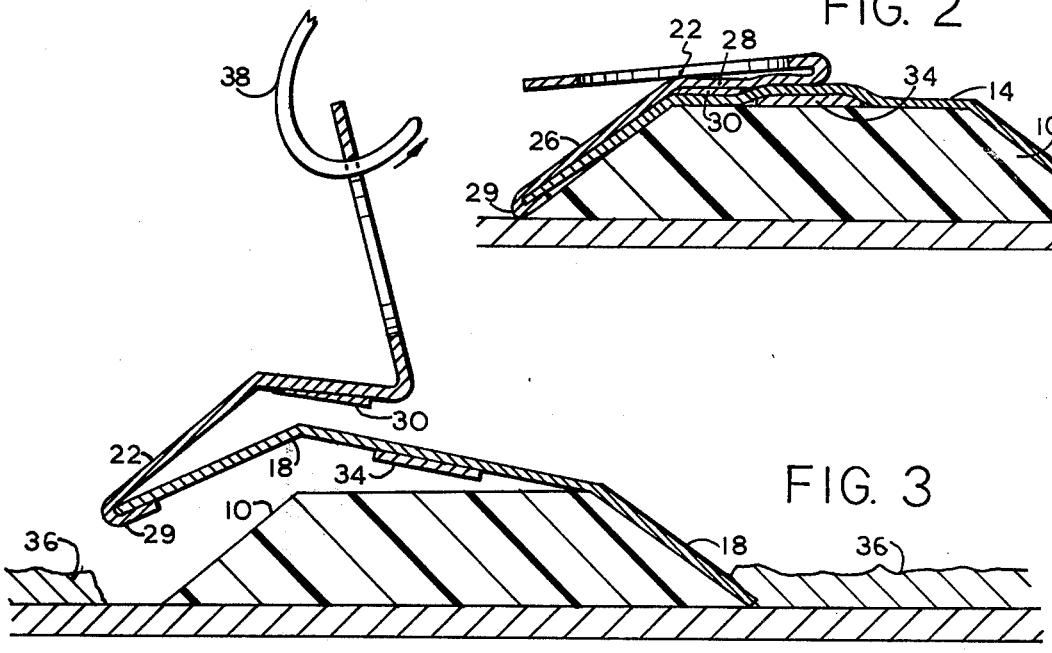
FIG. 3 is a section taken through a portion of the mask as it is being removed from a reflector subsequent to a re-surfacing operation on the roadway.
Figure 4:
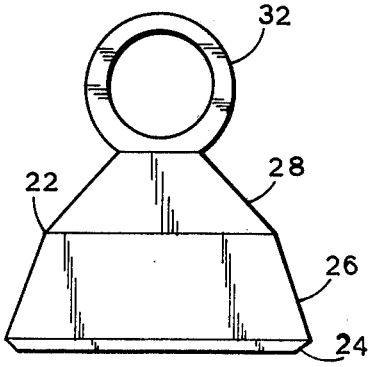
FIG. 4 is a plan view of a die cut of one portion of the mask.
Figure 5:
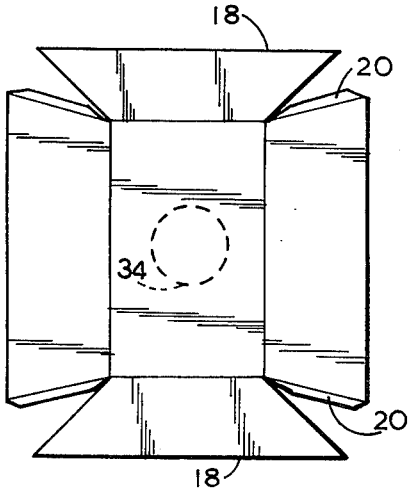
FIG. 5 is a plan view of a second dye cut representing the second portion of the mask.

Specifically, the reflector is preferably made in two parts, as shown in FIG. 4 and FIG. 5. The principal part is a cap 12 formed in fiber-reinforced paper or other tough but inexpensive material as a die cut shown in FIG. 5, or in other suitable manner. The cap 12 has a top panel 14, two identical side panels 16 and a pair of sloped, ramp-like end panels 18. Each of the side panels 16 is provided with a laterally extended ear or tab 20 which is used to adhere the respective side panel to the end panels 18 as shown in FIG. 1 to define a concave cup or cap 12. As can be seen in FIGS. 1, 2, and 3, the side end panels 16 and 18, when formed into the concave shape shown in FIG. 1, conform closely to the respective portions of the reflector 10 that the cap is designed to cover.

A second primary piece of the mask which could also be die cut from fiber-reinforced paper as shown at 22 comprises a pull-tab which is connected to one edge of one of the end panels 18 by means of a lip 24 extending along the bottom edge of the pull tab. This lip is attached to the underside of the cap 12 by any suitable adhesive as is best shown in FIG. 3.

The pull tab also has a first panel 26 which is shaped to lie flushly over one end panel 18, and a second panel 28 which is preferably provided with a spot 30 of adhesive such that in the masking mode of use the pull tab is maintained substantially flat and out of the way.

Extending from the second panel 28 at the pull tab is a pull ring 32. This ring may be reinforced with additional fibers, such as nylon, or it could be provided as a separate plastic ring and then made a part of the pull tab. In the masking mode, this ring lies flat as is shown in FIG. 2, or it could extend in the opposite direction from that shown in FIG. 2 with the same effect. It is desired that the ring extend beyond the cap portion 12 of the mask so that it is easily manually engaged as shown in FIG. 3 for quick removal when its use is finished.

In operation, prior to resurfacing the roadway, a worker either walks along or is driven along the affected centerline and rapidly places a mask on each reflector. Inside each reflector is a layer of adhesive 34 which firmly attaches the cup portion to the reflector. Thus it is very easy to attach the mask and represents a rather rapid process.

Once the masks have been put in position, a re-surfacing material such as 36 is spread over the roadway surface, the reflectors being protected and maintained clean of any such coating by the presence of the mask. Subsequent to the re-surfacing operation, a worker would ordinarily be driven by the line of reflector covers in a truck, and engages the ring portion of the pull tab with a special hook 38 and pulls each mask off as is shown in FIG. 3. The masks could be removed by an automatic hooking device and in any event, they are discarded subsequent to removal.

Because of the simplicity of the use of the mask which is inherent in it's novel and advantageous design, a tremendous number of the masks can be both applied and removed in any given period of time. Because of this, the nominal costs of the masks coupled with the probable high costs of labor used in their installation and removal still represents a cost per reflector that is insignificant compared to the costs of the labor involved in grading off the reflectors and scraping them, and the costs of providing completely new reflectors subsequent to the resurfacing project.

I claim:

1. A mask for a pavement-mounted highway reflector comprising:

(a) A cap dimensioned and shaped to fit over substantially the entire surface of a pavement-mounted highway reflector;

(b) A portion of the interior of said cap having adhesive applied thereto to connect said cap to a highway reflector;

(c) A pull-tab connected to said cap and having an end portion extending free of said cap, whereby subsequent to using said mask, same is rapidly removable by gripping and pulling said pull-tab to disengage said cap from a reflector.

2. A mask according to claim 1 wherein said pull-tab includes a pull-ring.

3. Structure according to claim 2 wherein said pull-tab is connected to the edge of said cap and extends above said cap to be readily accessible.

4. Structure according to claim 3 wherein said ring is connected to the distal end of said pull-tab and a portion of said pull tab is releasibly connected to the top of said cap to lie back over said cap and keep said tab lying substantially flat until it is desired to remove said mask.

5. Structure according to claim 1 wherein said mask is made of fiber-reinforced paper.

6. Structure according to claim 5 wherein said mask comprises two die-cut segments one of which is shaped and formed into a reflector-covering cap, and a second segment adhered to said first segment, one of said die cuts being generally rectangular having re-entrant cut-outs at the corners to define a top portion and four side portions, said cap having tabs extending from two edges of two of said portions for cementing to the remaining two side portions to produce a concave cap structure.

7. Structure according to claim 1 wherein said cap has two side panels and two sloped end panels to define a trapezoidal cross section through said end panels, and said pull tab is adhered to one edge of one of said end panels.

* * * * *